United States Patent [19]

Scholl

[11] 4,150,489

[45] Apr. 24, 1979

[54] ADJUSTABLE TEMPLATE FOR SEWING DEVICE

[75] Inventor: Hans Scholl, Oerlinghausen-Lipperreihe, Fed. Rep. of Germany

[73] Assignee: Kochs Adler AG, Bielefeld, Fed. Rep. of Germany

[21] Appl. No.: 848,151

[22] Filed: Nov. 3, 1977

[51] Int. Cl.[2] ..... B43L 13/22

[52] U.S. Cl. ..... 33/177; 112/121.12

[58] Field of Search ..... 112/121.12; 33/176, 33/177

[56] References Cited

U.S. PATENT DOCUMENTS

| | | | |
|---|---|---|---|
| 1,061,345 | 5/1913 | Weston | 33/177 |
| 1,086,440 | 2/1914 | Classon | 33/177 |
| 1,313,482 | 8/1919 | Hegardt | 33/177 |
| 3,107,434 | 10/1963 | Niel | 33/177 |
| 3,774,558 | 11/1973 | Scholl et al. | 112/121.12 |

*Primary Examiner*—Charles E. Phillips
*Attorney, Agent, or Firm*—Max Fogiel

[57] ABSTRACT

An adjustable template for use in a sewing device for sewing workpieces of different shapes. The template has a supporting plate and a plurality of segments each having wedge-shaped lateral edges, a bearing surface for a template follower means and a slot-shaped clearance formed in the bearing surface, for receiving and slidably fastening a flexible connection wire. As a result of connecting all segments at their bearing surfaces, only several of the plurality of segments are secured to the supporting plate. Consequently, an alignment of the bearing surfaces of the segments according to a required course of a seam, is simplified.

4 Claims, 4 Drawing Figures

"A"
III
III

ADJUSTABLE TEMPLATE FOR SEWING DEVICE

BACKGROUND OF THE INVENTION

The invention relates to a template for use in a sewing device for sewing workpieces of different shape and which is arranged on a supporting plate and on which bears a driven template follower.

U.S. Pat. No. 3,774,558 discloses an adjustable template for use in a sewing device for sewing workpieces of different shape and size in which there is provided a supporting plate with a plurality of slotted holes arranged in longitudinal and angular direction with respect to the supporting plate, a plurality of segments having wedge-shaped lateral edges, a bearing surface for a template follower and an oblong hole in the longitudinal direction of each of the segments, and a bolt within the oblong holes and the slotted holes for fastening each of the segments to the supporting plate after alignment of the bearing surfaces of the segments according to the required course of the seam. However, in order to change the course of the curve it is necessary to loosen the bolt assigned to each of the segments before the alignment of their bearing surfaces according to the required course of the seam, can take place.

It is an object of this invention to improve the adjustable template, shown in U.S. Pat. No. 3,774,558, in such a manner, that for securing the template consisting of a plurality of single segments to the supporting plate, some bolts only are necessary.

It is a further object of the present invention to provide a template consisting of a plurality of single segments, the bearing surfaces of which forming the path for the template follower, are ridgeless alignable to each other within a minimum of time.

It is another object of the present invention to provide an arrangement for holding the segments plan parallel with the supporting plate carrying the segments.

Still a further object of the present invention is to provide a profilated elongating arrangement for the template.

SUMMARY OF THE INVENTION

According to the present invention, the above objects are achieved by providing an adjustable template, which comprises a supporting plate provided with a plurality of slotted holes arranged in longitudinal direction with respect to said supporting plate, a plurality of segments having wedge-shaped lateral edges, a bearing surface for a template follower, an oblong hole in the longitudinal direction of each of the segments and in a longitudinal direction, a flexible connection wire received and slidably fastened in the slot-shaped clearances of the segments and a bolt in the oblong holes and the slotted holes for fastening several of the segments to the supporting plate after alignment of the bearing surfaces of the segments according to the required course of a seam.

For preventing those segments which are unfixed on the supporting plate from deviating about the connection wire, there are provided a locking wire bridging and resting on all segments, and a clamping unit for fastening the locking wire to at least two of the segments secured to the supporting plate.

The adjustable template further comprises a separate template part fastened to the supporting plate, a guide rail provided with a recess and bridging the space between the separate template part. One of the segments has a taphole. The guide rail is fastened to the separate template part and the segment. The template follower is provided with an elongated part for cooperating with the guide rail.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3, 4:
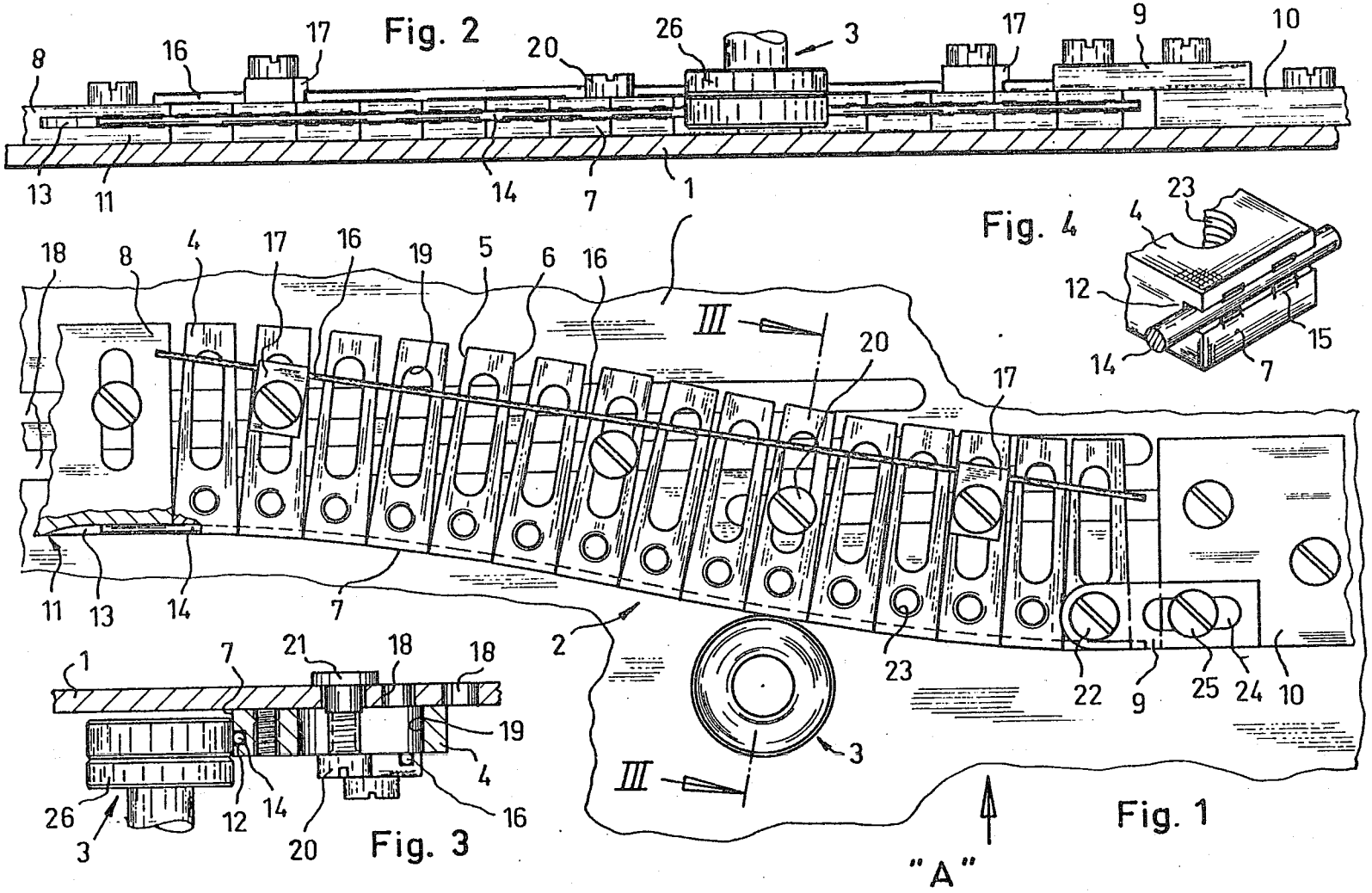
FIG. 1 is a bottom plan view of the template according to the present invention.
FIG. 2 is a view in direction of arrow "A" in FIG. 1.
FIG. 3 is a section taken along line III—III of FIG. 1.
FIG. 4 is a perspective partial view of a segment showing the connection wire, on an enlarged scale.

In a sewing device, not shown in the drawings but well known from U.S. Pat. No. 3,774,558, a supporting plate 1 is mounted for receiving a template 2 (FIG. 2) having a bearing surface for a driven template follower 3.

The template 2 consists of a plurality of single segments 4, which are formed with wedge-shaped lateral edges 5, 6 and a bearing surface 7 for the template follower 3, an end section 8, a separate template 10 fastened to the supporting plate 1, and a guide rail 9 provided with a recess 24 and bridging the space between the separate template part 10 and one of the segments 4. The segments 4 and the end section 8 are provided with slot-shaped clearances 12, 13 formed in the bearing surfaces 7, 11 for receiving a connection wire 14 which is fastened by means of calkings 15 (FIG. 4). However, the segments 4 are allowed to move on the connection wire 14 in axial direction.

Several of the segments 4 are secured to the supporting plate 1 by means of bolts 20, 21, which are received in oblong holes 19 formed in the segments 4 (FIGS. 1 and 3) and in slotted holes 18 arranged in the supporting plate 1 in longitudinal direction with respect to the supporting plate 1. Likewise, the end section 8 and the separate template part 10 are movably fastened in the slotted holes 18 of the supporting plate 1.

For preventing those of the segments 4 which are not fixed on the supporting plate 1, from deviating about the connection wire 14, a locking wire 16 bridging and resting on all segments is fastened to at least two of the segments 4 by means of clamping pieces 17.

The guide rail 9 is provided with a recess 24 and is secured to one of the segments 4 and the separate template part 10, by means of screws 22 received in a taphole 23 located in the segments 4 (FIGS. 1 and 4) and in the separate template part 10.

The template follower means 3 (FIGS. 1 to 3) is provided with an elongated part 26 for cooperating with the guide rail 9, which lies in the path of motion of the elongated part 26 of the roller 3.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An adjustable template for use in a sewing device for sewing workpieces of different shape, comprising:

a supporting plate having a plurality of slotted holes arranged in longitudinal direction with respect to said supporting plate, a plurality of segments having
wedge-shaped lateral edges,
a bearing surface for a template follower means,
an oblong hole in longitudinal direction, and
a slot-shaped clearance being formed in said bearing surface in a longitudinal direction, a flexible connection wire received and slidably fastened in said slot-shaped clearances of said segments, bolt means in said oblong holes and said slotted holes for fastening several of said segments to said supporting plate after alignment of said bearing surfaces of said segments according to a required course of a seam, a locking wire bridging and resting on all segments for preventing those of said segments which are unfixed on said supporting plate, from deviating about said connection wire and clamping means for fastening said locking wire to at least two of said segments secured to said supporting plate.

2. An adjustable template according to claim 1, further comprising a separate template part secured to said supporting plate, a guide rail having a recess and bridging the space between said separate template part and one of said segments, said guide rail being in the path of motion of an elongated part of said follower means, and means for fastening said guide rail to said separate template part and one of said segments.

3. An adjustable template for use in a sewing device for sewing workpieces of different shape, comprising:

a supporting plate having a plurality of slotted holes arranged in longitudinal direction with respect to said supporting plate, a plurality of segments having
wedge-shaped lateral edges,
a bearing surface for a template follower means,
an oblong hole in longitudinal direction, and
a slot-shaped clearance being formed in said bearing surface in a longitudinal direction, a flexible connection wire received and slidably fastened in said slot-shaped clearances of said segments, bolt means in said oblong holes and said slotted holes for fastening several of said segments to said supporting plate after alignment of said bearing surfaces of said segments according to a required course of a seam, the bearing surfaces of said segments forming a substantially uninterrupted bearing surface for said follower means independent of adjustments for changing the course of a seam; said course of said seam having permissible curves of relatively small and relatively large radii of curvature.

4. An adjustable template according to claim 3, further comprising a separate template part fastened to said supporting plate, a guide rail having a recess and bridging the space between said separate template part and one of said segments, said one segment having a taphole, means for fastening said guide rail to said separate template part and said segment, said template follower means having an elongated part for cooperating with said guide rail.

* * * * *